US006177128B1

(12) United States Patent
Goppert-Berarducci et al.

(10) Patent No.: US 6,177,128 B1
(45) Date of Patent: Jan. 23, 2001

(54) METHOD FOR PREDICTING COATABILITY

(75) Inventors: Kim E. Goppert-Berarducci, Webster; Eugene P. Higgins, Pittsford, both of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/305,611

(22) Filed: May 5, 1999

Related U.S. Application Data

(63) Continuation of application No. 09/036,060, filed on Mar. 6, 1998, now abandoned.

(51) Int. Cl.[7] ..... B05D 1/30

(52) U.S. Cl. ..... 427/8; 427/240; 427/402; 427/420

(58) Field of Search ..... 427/8, 240, 402, 427/420; 118/DIG. 4

(56) References Cited

FOREIGN PATENT DOCUMENTS 0 769 717 A1 * 4/1997 (EP) .

OTHER PUBLICATIONS

Encyclopedia of Surfactants, vol. 1, Compiled by Michael and Irene Ash, p. 54 Alkanol S—Alkaphos 3 (No Date).

* cited by examiner

*Primary Examiner*—Katherine A. Bareford
(74) *Attorney, Agent, or Firm*—Mark G. Bocchetti

(57) ABSTRACT

The bead and curtain coating methods for coating photographic compositions on smooth receiving surfaces at speeds about 300 ft/min are improved by the addition of a predictive step for the effect of the receiving surface on coating latitude. This step involves measuring the speed for entraining air for coating aqueous compositions from a nozzle applicator such as a capillary tube on the receiving surface and computing an index value predictive of bead and curtain coating performance.

11 Claims, 4 Drawing Sheets

| RDC INDEX RANGE | DESCRIPTION | SURFACTANT AT 0.01% W/W - RDC INDEX | SURFACTANT AT 0.1% W/W - RDC INDEX |
|---|---|---|---|
| >0.8 | COATING TO SPEEDS EXCEEDING 800 FPM | ALKANOL XC - 0.9<br>SAPONIN - 0.9 | ALKANOL XC - 0.9 |
| 0.5 TO 0.8 | COATING TO SPEEDS SIGNIFICANTLY EXCEEDING 300 FPM | AEROSOL OT-0.6<br>TRITON X200-0.6<br>IOG - 0.6 | |
| 0 TO 0.5 | COATING SPEED LIMITED BY RECEIVING SURFACE | FT248-0.4 | SAPONIN - 0.5<br>AEROSOL OT - 0.5<br>TRITON X200-0.5<br>IOG - 0.3<br>FT 248-0.4 |

FIG. 5

METHOD FOR PREDICTING COATABILITY

CROSS-REFERENCE TO RELATED APPLICATIONS

This application is a continuation of U.S. Ser. No. 09/036,060, filed Mar. 6, 1998, now abandoned.

The invention relates to a coating method and particularly to a coating method for photographic films and papers. More particularly, the invention addresses the optimization of a coating method whereby the time and cost for formulating and manufacturing products is reduced.

BACKGROUND OF THE INVENTION

Coated photographic products normally comprise one or more layers of a hydrophilic colloidal composition. The vehicle for these compositions is usually gelatin and the layers are coated onto substrates including paper and acetate and polyester films. The substrates may possess a thin subbing layer to promote adhesion of the layers. The subbing layer is typically a hydrophilic colloidal composition comprising gelatin and other addenda including a cross-linking agent, other polymers, matte particles, and surfactants.

Sometimes multilayer photographic products are coated in four or more stages that may follow in one continuous manufacturing line. The second and later stages are coated onto product layers that have been coated and dried; only the first stage is coated directly on an original receiving surface of paper or plastic that may be subbed. The product layers are typically dispersions and emulsions in a gelatin vehicle. The compositions typically contain surfactants as dispersing aids. The compositions are chemically complex.

Economical and reliable manufacturing requires high speeds of coating and a robust coating process. Indeed, it is desirable that manufacturing processes be so reliable that the numerous inspection, sorting, disposition, rework steps, and large inventories characteristic of past manufacturing processes be eliminated to reduce cost. At the same time, it is desirable to reduce greatly the time it takes to formulate new products and bring them to market. Reduced cycle time, as it is called, can make the difference between success and failure in the highly competitive global marketplace. As coating speeds have increased for economic reasons, significant differences in coating latitude among receiving surfaces have become apparent. Manufacturing photographic products may involve several coating operations with as many different receiving surfaces, any one of which may limit productivity. So, it is important that all receiving surfaces be conducive to coating.

The importance of the surface properties of the receiving surface to coating performance has been largely unrecognized in public technical literature; for example, Buonopane R A, Gutoff E B, & Rinmore MMTR, 1986, *AIChE J.*, 32, p. 682, and Burley, R., 1992, JOCCA., 5, p. 192. However, in formulating and coating photographic products, large differences among receiving surfaces are observed. For example, the limit of coating speed, usually marked by the entrainment of air between the coating compositions and the receiving surface, can vary by an order of magnitude. A receiving surface with poor properties can severely restrict manufacturing performance. Thus, the ability to predict coating performance on various receiving surfaces quickly and inexpensively can be useful and valuable.

Although coating performance cannot be left to chance, methods to predict performance quickly and inexpensively are virtually nonexistent. Past experience with compositions can be helpful, but it is difficult to recognize when a significant change has been made given the chemical complexity of photographic compositions. Predictions based on scientific and engineering models and principles are not possible because much of coating mechanics, and particularly the high speed wetting of a receiving surface that is the heart of coating, remains an enigma (for example, Shikhmurzaev, Y. D., *J Fluid Mech.*, 334, 1997). As a result, in the prior art coating performance is evaluated empirically on pilot coating machines. These coating machines are called pilot machines because they are much narrower than production coating machines, but they must otherwise duplicate manufacturing conditions such as speed. Such pilot machines are therefore expensive to build, operate, and maintain. Thus, the predictive step of pilot coating practiced in prior art is costly and time consuming and at odds with the modern manufacturing objectives already recited. What may be an even worse drawback is that materials being evaluated for new product formulations may not be readily available in the quantities required for high speed pilot coating. So, costly delays in product programs or compromised formulations can result.

One useful method for characterizing the coating latitude of receiving surfaces and maximizing coating speeds based on the results has been disclosed in European Patent Application EP 0 769 717 A1. The method involves measuring the free energy components of receiving surfaces and ensuring through materials selection that these components lie within specified ranges. Specifically, static advancing contact angles of suitably chosen test liquids (water, 1-bromonaphthalene, and 2,2'-thiodiethanol) on the receiving surface are measured, and the method of Fowkes (1962, *J. Phys. Chem.*, 66, p. 382) is employed to determine the free energy components of the receiving surface.

This method for evaluating receiving surfaces for coating speed is useful but has some drawbacks and limitations. The method has proven most reliable for predominantly gelatin/surfactant receiving surfaces, as subbed film is likely to be. Suitable test liquids cannot be found in all cases. The reliable measurement of static advancing contact angles requires considerable skill and experience. Phenomena that occur over the relatively long time of a contact angle measurement but do not occur to a meaningful extent in a coating process can invalidate a measurement. For instance, the test liquid may be adsorbed by the receiving surface, or components of the receiving surface may dissolve or leech into the test liquid, thereby rendering the data questionable. In addition, the time it takes for the test liquid to equilibrate severely limits the capability of the test. So, for some receiving surfaces the method cannot be carried out or the prediction is uncertain.

It would be advantageous to devise a method for evaluating the coatability of substrates for various coating and the appropriate coating temperatures for coating operations for photographic film and paper without having to use a pilot plant operation to determine each situation individually and to avoid the time-consuming process described in European Patent Application 0 769 717 A1.

SUMMARY OF THE INVENTION

Accordingly, an object of the invention is to provide an improved coating method for which coating performance can be reliably, rapidly, and inexpensively ensured even when only small amounts of materials are available.

French patent FR 2721399 discloses an instrument for studying the entrainment of air when a liquid flows onto a moving receiving surface. The instrument is referred to as the rotating disk coater, or RDC. This device comprises a disk rotating at constant angular speed on which a sample of a receiving surface is placed and a nozzle immediately above the receiving surface for flowing a test liquid onto the receiving surface. To prevent coating over previously applied liquid, the nozzle translates radially inward at a steady speed. This inward translation also has the effect of decreasing coating speed with time. This general type of coating device is used, for example, to supply an excess of coating composition to a receiving surface in preparation for a spin coating process.

Typically, using the method of European Patent 0 769 717 A1, 25 receiving surfaces can be evaluated per day. The proposed method herein disclosed can easily evaluate 50 such receiving surfaces per day.

It has been found unexpectedly that the RDC has predictive value for the coating processes used in the manufacture of photographic products. These coating methods are, specifically, multilayer slide bead coating as described in U.S. Pat. No. 2,716,419 and multilayer slide curtain coating as described in U.S. Pat. No. 3,508,947. Specifically, the speed at which air entrainment ceases on the RDC can be used to anticipate bead coating and curtain coating performance. Absolute speeds can differ, but relative performance can be predicted. So, the speed at which air entrainment ceases for a receiving surface on the RDC is normalized by dividing by the speed at which air entrainment ceases on the RDC of a reference receiving surface that is conducive to coating to obtain an index number having no dimensions. RDC index values exceeding 0.5 indicate advantageous receiving surfaces for bead and curtain coating at speeds exceeding 300 feet per minute, and an index exceeding 0.8 indicates particularly advantageous receiving surfaces for speeds exceeding 800 feet per minute. High index values can be achieved by judicious alteration of the chemical composition or the temperature of the receiving surface. The fast and inexpensive RDC index measurement facilitates the screening of the many possible combinations of materials and temperature even when only small amounts of materials are available.

This method can also be run by placing a nozzle on a conveyance system where the receiving surface is conveyed at varied speed under the nozzle at constant height.

The advantages of this invention are obtained by providing a receiving surface with a roughness $R_z$ less than about 3 microns and applying a coating composition making wetting contact with said receiving surface the speed of said receiving surface exceeding 300 feet per minute comprising the steps of obtaining samples of said receiving surface; measuring the RDC index of said samples of said receiving surface; altering the temperature and chemical composition of said receiving surface to achieve an RDC index exceeding 0.5; and coating said coating compositions onto said altered receiving surfaces having RDC indices exceeding 0.5 at speeds exceeding 300 feet per minute whereby coating performance is attained without time consuming and costly experimentation on coating machines.

Accordingly, a method of coating comprises bead coating or curtain coating of speeds exceeding 300 feet per minute a plurality of photographic coating compositions comprising aqueous gelatin on a receiving surface in a coating environment comprising specified temperature and humidity comprising the steps of:

(a) providing said receiving surface with a roughness Rz less than about 3 microns;

(b) obtaining a sample of said receiving surface;

(c) measuring the rotating disk coater index value (RDC index value) of said sample by:

1. providing a test liquid comprising aqueous gelatin;
2. providing a test receiving surface;
3. providing a test environment of temperature and humidity corresponding to said coating environment;
4. spacing a nozzle from said test receiving surface in said test environment by a distance of at least 1 mm but not exceeding a distance of three times the maximum dimension of the opening of said nozzle;
5. flowing said test liquid out said nozzle at a flow rate sufficient to form a ribbon of test liquid between said nozzle and said test receiving surface;
6. rotating said test receiving surface at constant angular velocity about a center initially spaced from said nozzle such that the speed of said test receiving surface with respect to said nozzle is high enough that air entrainment is observed;
7. translating said nozzle radially inward, the speed of said test receiving surface with respect to said nozzle thereby decreasing; and recording the radial position of said nozzle when air entrainment is observed to cease;
8. computing the test speed value at which air entrainment is observed to cease from said recorded radial position and said constant angular velocity;
9. providing a reference receiving surface of polyethylene terephthalate at a relative humidity of 50% at 21° C. measuring said test speed value;
10. dividing said test speed value for said sample of said receiving surface by said test speed value for said reference receiving surface to obtain said RDC index value;

(d) determining if said RDC index value for said receiving surface is less than 0.5;

(e) obtaining an altered receiving surface by altering its chemical composition or by altering said test environment and measuring the RDC index value of said altered receiving surface, one or multiple times, until said RDC index value of said altered receiving surface exceeds about 0.5;

(f) altering said coating environment to correspond to said altered test environment; and (g) coating without air entrainment said photographic coating compositions onto said altered receiving surface in said altered coating environment at a speed exceeding 300 feet per minute by said curtain coating or bead coating method.

BRIEF DESCRIPTION OF THE DRAWINGS

FIG. 5 shows a tabulation of RDC index values for two levels of several surfactants in a gelatin-coated receiving surface.

Figure 1:
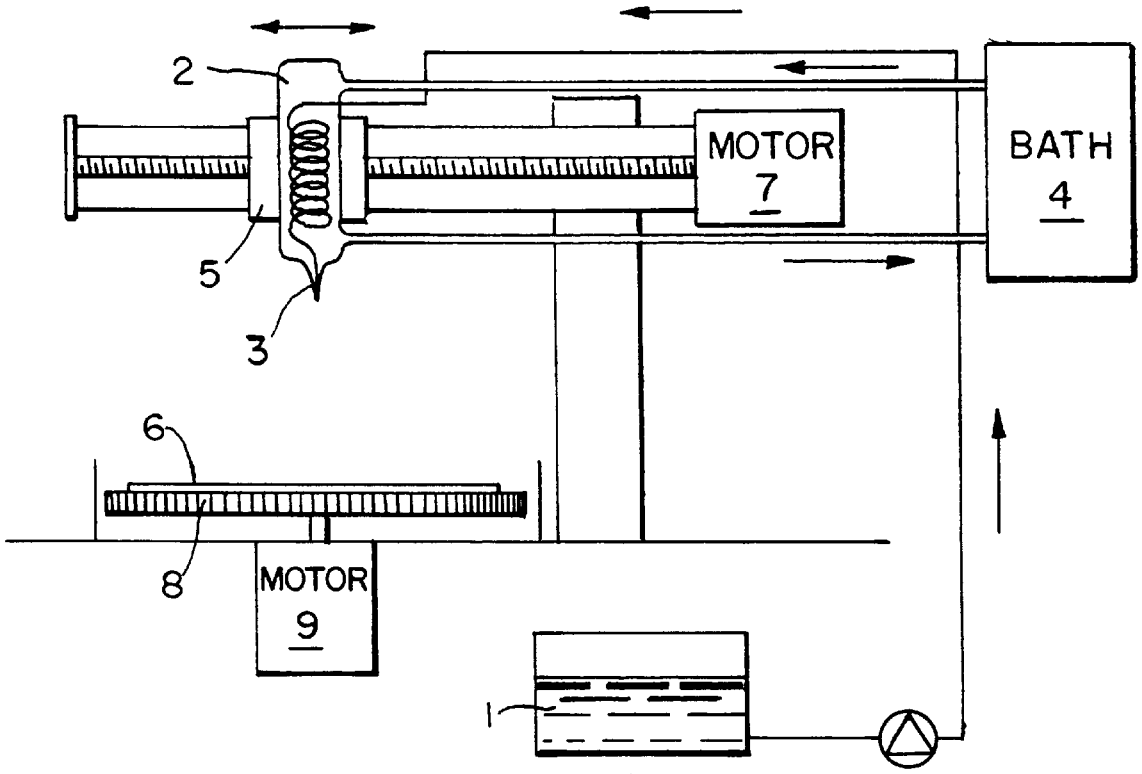
FIG. 1 shows a schematic of a rotating disk coater (RDC) useful in the present invention.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE INVENTION

The schematic drawing of the rotating disk coater, or RDC, in FIG. shows the main components of the instrument. A vessel 1 contains a supply of the test liquid that is applied to receiving surface 6 supported on rotating disk 8. The test liquid is pumped to capillary tube 3 located just above receiving surface 6. A motor 9 turns the disk at constant angular velocity. Capillary tube 3 is mounted to a stage 5 that is translated horizontally and radially inward at constant linear speed by motor 7. A hot water bath 4 supplies temperature-controlled water to a jacket 2 surrounding the conduit conveying the test liquid to the nozzle. The conduit is coiled within the jacket to enhance its effectiveness at ensuring the temperature of the test liquid.

It is crucial that the test liquid be the same as the intended coating solutions. That is, if the intended coating solution contains aqueous gelatin, the test solution must contain gelatin or if the intended solution contains a solvent, that solvent must be in the test solution. An aqueous solution of 15% gelatin is sensitive to the properties of most receiving surfaces used in the manufacture of photographic products, giving a clear signal, and entrains air on all receiving surfaces at speeds low enough, 150 to 1000 feet per minute, to facilitate the detection of entrained air. Lower concentrations of gelatin can be used less advantageously. For instance, a more dilute solution increases the measured speed, and a larger disk may be required. An object of the invention is to minimize the sample size of the receiving surface required for a measurement; typically, sample size is a diameter of 25–50 centimeters.

At the start of the measurement, the nozzle is positioned near the edge of the sample of the receiving surface, that is, at the farthest radial position. The speed is high enough that air is entrained between the test liquid and the receiving surface. Because the disk rotates at constant angular speed and the nozzle translates radially inward at constant linear speed, the coating speed of the RDC decreases linearly with the radial distance of the nozzle. It is this decreasing coating speed that eventually causes air entrainment to cease. Most often, air entrainment is indicated by lifting of the coating meniscus as the liquid loses contact with the receiving surface, and air bubbles may be present on the coated disk. Support roughness exceeding about 3 microns, as defined by the mean surface depth $R_z$ as described in DIN4768 which is the German Standard which is equivalent to the ASTA Standard (ISO4287), can reduce bubble size to the extent that magnification is required for detection.

The standard temperature of the test liquid is 40 degrees Centigrade. At this temperature, 15% aqueous gelatin has a viscosity in the range 60–70 centipoise. The inside diameter of the capillary is in the range 0.9–2.5 millimeters. The flow rate to the capillary is chosen such that the average velocity, obtained by dividing the volumetric flow rate by the cross-sectional area corresponding to the inside diameter of the capillary, is approximately 90 centimeters per second. The height of the mouth of the capillary above the receiving surface is at least 1.5 millimeters, and the maximum spacing is three times the inside diameter. The speed of radial translation of the nozzle such as a tube is in the range 0.5–2.5 centimeters per second, and the disk rotational speed is in the range 4–40 radians per second. The preferred inside diameter of the capillary is 1.150+/−0.005 millimeters, and the corresponding preferred flow rate is 56.0+/−0.1 cubic centimeters per minute. The preferred outside diameter of the capillary is 1.5+/−0.1 millimeters. The preferred height of the mouth of the capillary tube above the receiving surface is 3.0+/−0.1 millimeters. The RDC index values reported below were obtained at the preferred operating conditions.

Relative humidity can affect the index for some receiving surfaces and must be controlled. In the absence of specifically required conditions, measurements are performed at a humidity corresponding to 50% relative humidity at 21 degrees Centigrade.

The reference receiving surface for computing the RDC index can be polyethylene terephthalate (PET). This surface is conducive to high speed bead and curtain coating and is readily obtainable; in addition, RDC measurements on this surface have been reproducible. By definition, the RDC index for polyethylene terephthalate without a subbing layer is 1.0. Most receiving surfaces give index values below 1.0; relatively few give values greater than 1.0.

Figure 2:
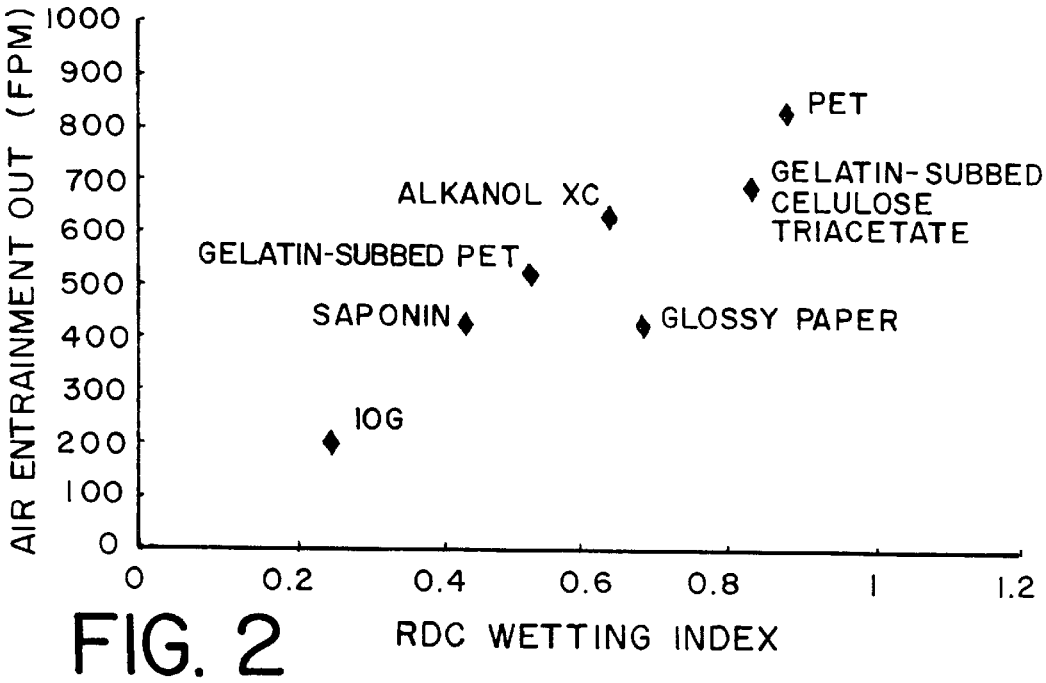
FIG. 2 is a plot of RDC index values versus air entertainment speed.

Referring next to the scatter plot of FIG. 2, the speed of entrainment of air in bead coating against the RDC index of the receiving surface can be measured. The coating composition for bead coating is 10.8% aqueous gelatin having a viscosity at 40 degrees Centigrade of 20 centipoise. The angle of the slide was 15 degrees from horizontal, the gap between the applicator lip and the receiving surface was 0.25 millimeters, and the suction differential applied to the bead as a coating assist was 125 Pascals. The receiving surfaces, having a temperature of 26 degrees Centigrade, include polyethylene terephthalate film subbed with gelatin, cellulose triacetate film subbed with gelatin, and glossy, polyethylene-coated paper. In other cases the receiving surface had a previously coated and dried layer applied that may be referred to as a gel pad; this layer contained gelatin and various surfactants. These surfactants are 10G (Olin Corp.), Saponin (Berghausen Corp.), and Alkanol XC (E. I. DuPont de Nemours). Coating performance, as measured by the speed of air entrainment, increases with RDC index.

There are measures beyond the speed of air entrainment indicating robustness or latitude for bead coating. Perhaps the most useful of these is suction assist latitude: the range of differential pressures applied to the bead that produces a uniform coating. The larger the suction assist latitude, the more robust is the coating position. The absence of suction assist latitude means that uniform coating is not possible. The limits to suction assist latitude can be one of several failures of the bead method. At the lower limit of suction assist, air entrainment or breaklines is most often encountered; (breaklines is the breaking of the bead into segments such that portions of the receiving surface are left uncoated). At the higher suction limit, pull through is most often encountered; some of the supplied coating composition fails to transfer to the receiving surface and instead descends through the gap between the applicator lip and the receiving surface. Another failure of the bead coating method sometimes encountered at the higher limit of suction assist is ribbing lines or rakelines, an instability in which the bead corrugates and thereby produces longitudinal streaks in the coating that are spatially periodic across the width of the coating. Generally, a suction assist latitude of at least 125 Pascals is preferred for robust, reliable manufacturing.

Figure 3:
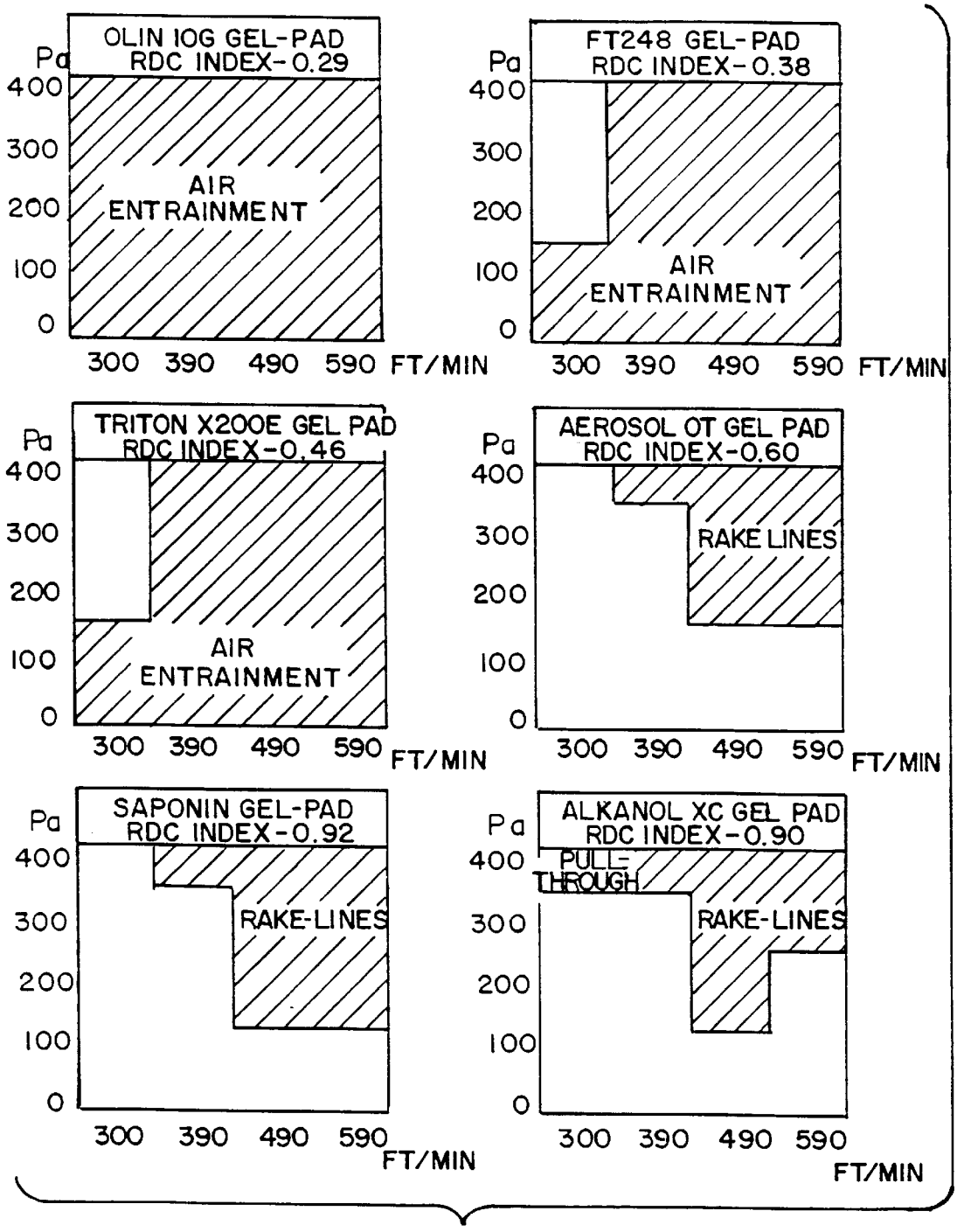
FIG. 3 shows maps of suction assist latitude for bead coating at four coating speeds for receiving surfaces of differing RDC index values.

FIG. 3 shows the suction assist latitude, in Pascals, for coating speeds of 300, 390, 490, and 590 feet per minute, for 6 gel pads. For the receiving surface with the lowest RDC index value, the gel pad containing Olin 10G, no suction latitude was found. At the other extreme, the receiving surface with the highest RDC index value, the gel pad containing Alkanol XC, exhibits usable suction latitude.

Figure 4:
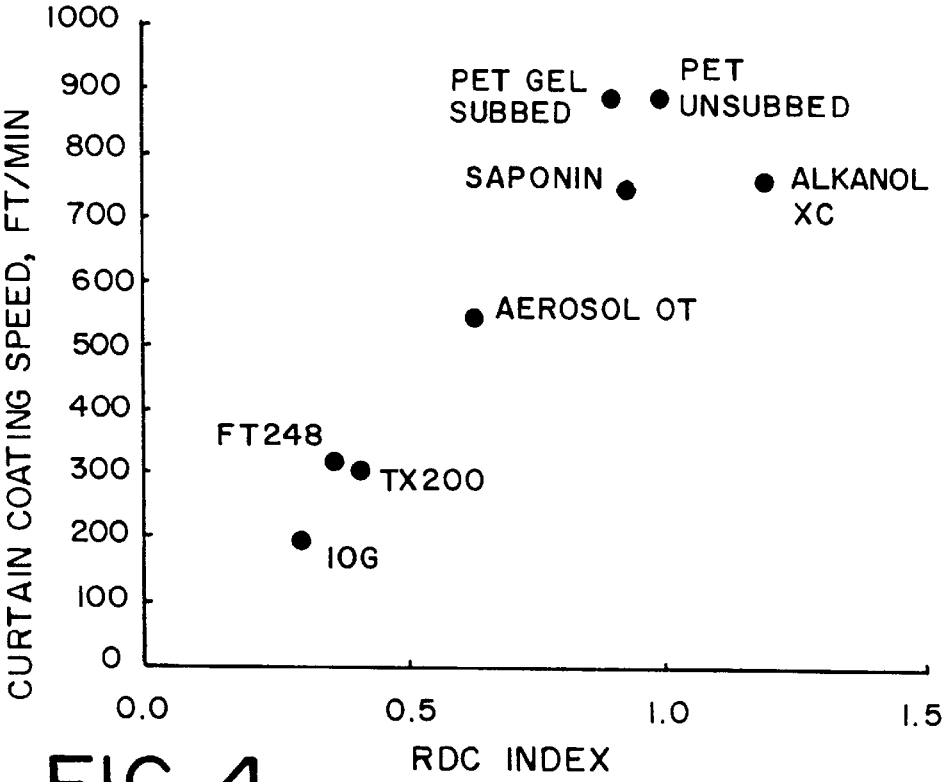
FIG. 4 shows a relationship between RDC index values and performance in curtain coating as measured by air entrainment speed maximized over flow rate.

The RDC index has similarly proven useful for the practice of curtain coating. The most common limitation in curtain coating is the entrainment of air between the coating composition and the receiving surface. It is known (for example, International Publication Number WO 92/11572, and Blake, T. D., Clarke, A., and Ruschak, K. J., 1994, *AIChE J.*, 40, p. 229) that air entrainment speed in curtain coating depends upon the total flow rate of the coating composition. There is one flow rate that maximizes coating speed. At higher or lower flow rates, coating speed decreases. This maximum speed, denoted $S_m$., depends upon the height of the curtain and the angle between the curtain and the receiving surface, as taught in the references. $S_m$ is characteristic of curtain coating latitude. FIG. 4 is a plot of $S_m$ against RDC index for the curtain coating of 15% aqueous gelatin on various receiving surfaces. The receiving surfaces, having a temperature of 26 degrees Centigrade, include polyethylene terephthalate film subbed with gelatin and gel pads containing various surfactants. These surfactants arc 10G (Olin Corp.), Saponin (Berghausen Corp.), Alkanol XC (E. I. DuPont de Nemours), FT248 (Bayer AG), and Triton X200 (Union Carbide). For this data, the height of the curtain is 3 centimeters, and the angle between the curtain and receiving surface is 90 degrees. As in bead coating, the latitude for curtain coating increases with RDC index.

Experience with the bead and curtain coating methods practiced according to known art establishes that an RDC index exceeding about 0.5 is required to ensure manufacturing speeds of at least 300 feet per minute, about the lowest commensurate with economical manufacturing. Similarly, an RDC index exceeding about 0.8 is required to ensure manufacturing speeds exceeding about 800 feet per minute.

One way to influence the coating latitude of receiving surfaces is though the choice of surfactant in the receiving surface. Surfactants are chemicals that, although added to a coating composition in small quantities, typically on the order of 0.1 percent by weight, preferentially reside at the surface with air. Thus, surfactants are an efficient way to alter surface composition. Surfactants are present in coating compositions for many reasons; for example, they are added in the making of the dispersions and emulsions commonly found in photographic coating compositions. They are commonly used in aqueous coating methods as coating aids. Surfactants are added to suppress the formation of repellency spots, craters or voids in the coating caused by aggregations of surface active materials reaching the air interface and inducing flow by locally lowering surface tension. In a multilayer coating process, surfactants are added to the outermost of superimposed layers to ensure their spreading over neighboring layers. Any receiving surface to which an aqueous-based coating composition has been applied, including aqueous subbing compositions, will contain surfactant as a coating aid. A receiving surface to which a solvent-based coating composition has been applied may not contain surfactant because the surface tension of most solvents is naturally low.

Increasing surfactant amounts in receiving surfaces generally cause the RDC index to fall, as FIG. 5 demonstrates. So, it is frequently advantageous to limit surfactant additions to the minimum required for formulation and coating purposes. A surfactant like Alkanol XC (a sodium napthalene sulfanate) that maintains a high index even at high amounts is particularly useful.

The RDC index is similarly useful in predicting the effect of the temperature of the receiving surface on coating latitude. For example, the RDC index for a gel pad containing 10G surfactant can change from 0.26 at room temperature to 0.85 when heated. For the bead coating conditions recited previously, coating speed increases from 200 to 600 feet per minute, or the suction assist latitude at 200 feet per minute increases by 100 Pascals.

The temperature and chemical properties of the receiving surface control coating latitude for smooth surfaces, those having a surface roughness $R_z$ less than 3 microns. The invention has proven useful for such smooth surfaces. Rougher surfaces have other influences on coating latitude not captured by the rotating disk coater.

EXAMPLE 1

A receiving surface proposed as a substitute for an existing receiving surface was evaluated by the method of the invention. The RDC index for the existing surface was 0.51, and that for the proposed substitute was 0.37. The expected reduced coating performance was considered in the decision to use the substitute support. As a result, coating speeds were reduced by 20% in order to assure a robust coating.

EXAMPLE 2

The RDC index was used to screen 20 experimental receiving surfaces in a subbing replacement and standardization program. The selected replacement had an RDC index of 0.5, the same as that of the receiving surface to be replaced, even though its composition differed significantly. The replacement subbing formulation was accredited for manufacture and gives equivalent coating performance.

EXAMPLE 3

An externally supplied receiving surface of unknown chemical composition gave an identical coating latitude to an internally manufactured receiving surface. However, the method of EP Application 0 769 717 A1 evaluated the unknown receiving surface as giving much worse performance. The proposed method, herein disclosed, evaluated the two said receiving surfaces as giving identical coating latitude.

EXAMPLE 4

Using the method of EP Application 0 769 717 A1 to evaluate receiving surfaces comprising with subbings containing significant quantities of two alternative subbing vehicles to gelatin no differences were seen, though it is known that the surface compositions of said receiving surfaces were different.

The invention has been described in detail with particular reference to certain preferred embodiments thereof, but it will be understood that variations and modifications can be effected within the spirit and scope of the invention.

What is claimed is:

1. The method of coating by bead coating or curtain coating at speeds exceeding 300 feet per minute a plurality of photographic coating compositions comprising aqueous gelatin on a receiving surface in a coating environment comprising specified temperature and humidity comprising the steps of:

(a) providing said receiving surface with a roughness $R_z$ less than about 3 microns:

(b) obtaining a sample of said receiving surface;

(c) measuring the rotating disk coater index value (RDC index value) of said sample by;

1. providing a test liquid comprising aqueous gelatin;
2. providing a test receiving surface;
3. providing a test environment of temperature and humidity corresponding to said coating environment;
4. spacing a nozzle from said test receiving surface in said test environment by a distance of at least 1 mm but not exceeding a distance of three times the maximum dimension of said nozzle;
5. flowing said test liquid out said nozzle at a flow rate sufficient to form a ribbon of test liquid between said nozzle and said test receiving surface;
6. rotating said test receiving surface at constant angular velocity about a center initially spaced from said nozzle such that the speed of said test receiving surface with respect to said nozzle is high enough that air entrainment is observed;
7. translating said nozzle radially inward, the speed of said test receiving surface with respect to said nozzle thereby decreasing; and recording the radial position of said nozzle when air entrainment is observed to cease;
8. computing a test speed value at which air entrainment is observed to cease from said recorded radial position and said constant angular velocity;
9. providing a reference receiving surface of polyethylene terephthalate at a relative humidity of 50% at 21° C.;
10. repeating steps (c) 1 through 8 with said reference receiving surface;
11. dividing said test speed value for said sample of said receiving surface by said test speed value for said reference receiving surface to obtain said RDC index value;

(d) determining if said RDC index value for said receiving surface is less than about 0.5;

(e) if said RDC index value of said receiving surface is less than about 0.5, obtaining an altered receiving surface by altering its chemical composition or by altering said test environment and measuring said RDC index value of said altered receiving surface, one or multiple times, until said RDC index value of said altered receiving surface exceeds about 0.5;

(f) altering said coating environment to correspond to said altered test environment; and (g) coating without air entrainment said photographic coating compositions onto said receiving surface of (e) in said coating environment of (e) at a speed exceeding 300 feet per minute by said curtain coating or bead coating method.

2. The method according to claim 1 wherein said RDC index value exceeds 0.8.

3. The method according to claim 1 wherein surfactant additions are used to alter the chemical composition of said receiving surfaces.

4. The method according to claim 3 wherein sodium naphthalene sulfonate is used to alter said RDC index value of said receiving surfaces.

5. The method according to claim 1 wherein the application of coating composition is by bead coating.

6. The method according to claim 1 wherein the application of coating composition is by curtain coating.

7. The method according to claim 1 wherein the velocity of said test liquid is such that said test liquid issues from said nozzle at an average velocity of 90 centimeters per second.

8. The method according to claim 1 wherein said nozzle is a capillary tube of inside diameter 0.9–2.5 millimeters; a translation of said receiving surfaces is rotational at 4–40 radians/sec.; and said nozzle translates radially inward at 0.5–2.5 centimeters per second.

9. The method according to claim 8 wherein the inside diameter of said capillary tube is 1.15 millimeters and the outside diameter is 1.5 millimeters, and a spacing of said nozzle from said test receiving surface is 3 millimeters.

10. The method according to claim 9 wherein a flow rate to said nozzle is 56 cubic centimeters per minute.

11. The method according to claim 1 wherein the temperature of said receiving surfaces is altered to achieve a value greater than 0.8 for said index.

* * * * *